US008715787B2

(12) United States Patent
Moravčík et al.

(10) Patent No.: US 8,715,787 B2
(45) Date of Patent: May 6, 2014

(54) METHOD OF MAKING A COMPACT LAYER OF ENAMEL COATINGS ON MOULDED PRODUCTS

(76) Inventors: Alfonz Moravčík, Bratislava (SK); Martin Moravčík, Bratislava (SK)

( * ) Notice: Subject to any disclaimer, the term of this patent is extended or adjusted under 35 U.S.C. 154(b) by 0 days.

(21) Appl. No.: 13/476,604

(22) Filed: May 21, 2012

(65) Prior Publication Data

US 2012/0301626 A1 Nov. 29, 2012

(30) Foreign Application Priority Data

May 24, 2011 (SK) ..... 0043-2011
Aug. 19, 2011 (SK) ..... 50036-2011

(51) Int. Cl.
*B05D 1/06* (2006.01)
*B05D 7/14* (2006.01)

(52) U.S. Cl.
USPC ..... 427/470; 427/477; 427/479

(58) Field of Classification Search
USPC ..... 427/458, 470, 477, 479
See application file for complete search history.

(56) References Cited

U.S. PATENT DOCUMENTS 4,110,487 A * 8/1978 Rion ..... 427/470
6,032,871 A * 3/2000 Borner et al. ..... 239/3
2008/0014365 A1* 1/2008 Fotland et al. ..... 427/475

* cited by examiner

*Primary Examiner* — Frederick Parker
(74) *Attorney, Agent, or Firm* — Ohlandt, Greeley, Ruggiero & Perle, L.L.P.

(57) ABSTRACT

The invention relates to application of enamel layers in the form of powder in an electric field and subsequent firing. A cleaned surface of a steel product is covered with a ground coat enamel layer in the form of powder in the electric field by an application gun until the layer reaches a thickness of 100 to 150 μm. Subsequently, the electric field is interrupted in order to reduce a space charge around the metal product and, in the same manner, a minimum of another two layers of cover coat enamel powder is applied until a thickness of the total enamel powder layer reaches a minimum of 750 μm, wherein the electric field is interrupted each time between each steps of cover coat enamel powder application.

3 Claims, No Drawings

METHOD OF MAKING A COMPACT LAYER OF ENAMEL COATINGS ON MOULDED PRODUCTS

TECHNICAL FIELD

The invention relates to a method of making a compact layer of enamel coatings also on moulded products by means of application of enamel powders in an electric field.

STATE OF THE ART

Moulded products enamel coatings made by a method of application of enamel powders in an electric field, particularly by a two layer application, that is, a ground coat layer plus a cover layer, of enamel powder in a single firing process exhibit defects in compactness. For the said reason, the products intended for higher stress corrosion, such as enamel bath tubs, bath basins, boilers, and the like, have to be provided with another enamel powder cover coat layer in a repeated firing process.

Experimentally, it has been found that, especially in bilayer systems (an enamel powder ground coat layer plus an enamel powder cover coat layer) of moulded products, the enamel compactness after a firing process highly depends on thickness of the enamel powder layer. Therefore, it is necessary to make sufficiently thick enamel powder layers in the electric field in order to make enamel of approximate thickness of 250 μm after firing. Making a sufficiently thick layer of enamel powder in the electric field is, however, hampered by formation of a space charge as a result of gathering of the charged enamel particles of identical polarity on a product surface.

In making an enamel layer a value of the space charge depends on charge conduction and that is given by the equation:

$$Q=Q_0\cdot e^{-t/R\cdot C}$$

Q—Charge after time t [C]
$Q_0$—Initial charge [C]
t—Time
R—Specific electrical resistance of the particle [Ωm]
C—Capacity [F]
e—Elementary charge (value=$1.602176487(40)\cdot 10^{-19}$ [C])

After reaching a marginal value of the space charge, further growth of thickness of the enamel powder layer on the product is discontinued, be it before a required value of thickness of the enamel powder layer on the product is reached.

After firing, such product shows defects in the enamel coating caused by an insufficient layer of enamel powder. In particular, the defects relate to damage in compactness of the enamel coating, whereas the compactness of the enamel coating is a determining parameter in a protection function of the coating and it is an important quality sign.

SUBJECT-MATTER OF THE INVENTION

The said shortcoming is eliminated by a method of making a compact layer of enamel coatings on moulded products by means of application of enamel layers in the form of powder in the electric field and following-up the firing process, which essence is that a layer of ground coat enamel in the form of powder is applied on a cleaned surface of a steel product in the electric field by application guns until a thickness of the layer of 100-150 μm is reached, and subsequently the electric field is interrupted in order to decrease the space charge around the metal product and, in the same manner, a minimum of two layers of the cover coat enamel powder are applied until the total layer of enamel powder of a minimum thickness of 750 μm is reached, wherein the electric field is interrupted each time between each steps of cover coat enamel powder application.

According to a preferred embodiment, the interruption of the electric field in proximity of the product can be reached by a move of the product to another application location.

A method of enamel powder application in the electric field under the invention is performed by an interruption of the electric field at scheduled time intervals, where during the said interruption the value of the space charge decreases, by which a condition to restore growth of the enamel powder layer thickness is made. By the said repeated interruption of the electric field and restoration of the coating process, which can be programmed into the production facilities, a possibility to obtain extraordinary thickness of the enamel powder layer, and after its firing, the expected compactness of the enamel coating is achieved.

According to a preferred embodiment an overall thickness of the enamel powder layer can be 900 to 1000 μm.

Making enamel powder layers by a method of enamel powder application in the electric field can be performed on a fully automated production line consisting of several application cabins. In a first cabin, for example, making of a sufficient layer of the ground coat enamel powder is performed. In order to apply a sufficient layer of the ground coat enamel of a thickness of 30 to 40 μm after firing, it is necessary to make a layer of ground coat enamel powder of a thickness of 100 to 150 μm. In other cabins, e.g., four cabins, making of the sufficient layer of cover coat enamel powder is performed. In order to make the sufficient cover coat enamel layer of a thickness of about 250 μm after firing it is necessary to make a cover coat enamel powder layer of a minimal thickness of 750 μm. The product can be placed on an overhead conveyor so it can smoothly pass through the said positions, that is, the cabins. The enamel powder layers on the product surface are formed as a result of Coulomb's forces. Adhesive forces in the enamel powder layer depend on specific electrical resistance of the powder, air humidity, and intensity of the electric field at the time of enamel powder charging or by prolonging enamel powder charging time. The forces that attract the powder to the product surface are subtle; they cease in time and weaken by leaking of the charge from particles. A strong bond of the layer and the substrate metal is achieved by firing in a continuous tunnel kiln at temperature of about 800° C. to 840° C.

EXEMPLARY EMBODIMENT OF THE INVENTION

Example 1

Bath Tub Enameling

After moulding, products require surface pre-treatment before enameling. This phase primarily means cleaning the surface from oils, rust and other mechanical residue. The cleaning process is completely performed in an automated line, where drying is a final operation.

Layers of enamel powder were applied on the treated and cleaned surface of a steel bath tub in an electric field until a necessary thickness of, e.g., 900 μm was reached. Making of an enamel powder layer of a sufficient thickness by the method of enamel powder application in the electric field was performed on a fully automated line consisting of five application positions. Application of the first ground coat enamel layer was performed on the first application position and application of cover coat enamel layer was made on the four other application positions. The product was placed on an overhead conveyor and continuously passed through the said positions. On the first application position the ground coat enamel powder was applied from an application gun in the electric field until a required thickness of the ground coat enamel powder layer of approximately 100 μm was reached. After making the required layer of the ground coat enamel powder the application was discontinued and the product was moved to the second application position, whereby the electric field around the product was interrupted. On the second application position the cover coat enamel powder was applied in the electric filed by application guns until reaching the cover coat enamel powder layer thickness of approximately 150 to 250 μm. It took approximately 60 seconds to make such layer. Then, the application was interrupted and the product was moved to another application position. Other layers of the cover coat enamel powder were applied on the third to fifth positions in the same manner. The thickness of the enamel powder layer made on the product surface was 900 to 950 μm. A firm bond of the enamel powder layer and the substrate metal was reached by firing the product in a continuous tunnel kiln at a temperature of 820° C. The thickness of the enamel layer was approximately 260 μm after firing.

The invention claimed is:

1. A method of making a compact layer of enamel coatings on moulded metal products by applying enamel layers in the form of powder in an electric field and subsequent firing, the method comprising: a layer of ground coat enamel in the form of powder is applied on the cleaned surface of a metal product in the electric field by application guns until a thickness of the layer reaches 100 to 150 μm, and subsequently the electric field is interrupted in order to reduce a space charge around the metal product, and a minimum of two layers of cover coat enamel powder are applied until a total layer of enamel powder reaches a minimum thickness of 750 μm, wherein the electric field is interrupted each time between each of the steps of cover coat enamel powder application, wherein the interruption of the electric field around the metal product is carried out by moving the product to another application position.

2. A method of making a compact layer of enamel coatings on moulded metal products according to claim 1, wherein a total thickness of the layer of enamel powder is 900 to 1000 μm.

3. A method of making a compact layer of enamel coatings on a moulded metal product by applying enamel layers in the form of powder in an electric field and subsequent firing, the method comprising:

applying to a cleaned surface of a metal product a layer of ground coat enamel in the form of powder in the electric field until a thickness of the layer of 100 to 150 μm is reached, subsequently interrupting the electric field in order to decrease a space charge around the metal product, wherein the interruption of the electric field around the metal product is carried out by moving the product to another application position, applying a minimum of two layers of cover coat enamel powder over the layer of ground coat enamel until the total layer of enamel powder reaches a minimum thickness of 750 μm is reached and wherein the electric field is interrupted between each step of application of the cover coat enamel powder application to decrease value of the space charge to create a condition to restore growth of the enamel powder layer, in order to obtain a total minimum thickness of 900 to 1000 μm of the layer of enamel powder on the moulded metal product, and firing the powder coated molded metal product to obtain a compact enamel layer of a minimum thickness of 250 μm on the moulded metal product.

* * * * *